US009272191B2

(12) United States Patent
Saegusa et al.

(10) Patent No.: US 9,272,191 B2
(45) Date of Patent: Mar. 1, 2016

(54) BALL FOR BALL GAME

(75) Inventors: Hiroshi Saegusa, Hiratsuka (JP); Tsuyoshi Kitazaki, Hiratsuka (JP)

(73) Assignee: The Yokohama Rubber Co., LTD. (JP)

( * ) Notice: Subject to any disclaimer, the term of this patent is extended or adjusted under 35 U.S.C. 154(b) by 0 days.

(21) Appl. No.: 14/235,426

(22) PCT Filed: Jul. 26, 2012

(86) PCT No.: PCT/JP2012/004755

§ 371 (c)(1),
(2), (4) Date: Jan. 27, 2014

(87) PCT Pub. No.: WO2013/014932

PCT Pub. Date: Jan. 31, 2013

(65) Prior Publication Data

US 2014/0194233 A1 Jul. 10, 2014

(30) Foreign Application Priority Data

Jul. 27, 2011 (JP) ..... 2011-164688

(51) Int. Cl.
*A63B 43/00* (2006.01)
*A63B 37/00* (2006.01)

(52) U.S. Cl.
CPC ..... *A63B 43/004* (2013.01); *A63B 37/00* (2013.01); *A63B 2243/0004* (2013.01)

(58) Field of Classification Search
CPC ..... A63B 43/004; A63B 37/00; A63B 2243/0004
USPC ..... 473/570, 594, 577, 595, 600–605, 351, 473/359–362, 372, 373
See application file for complete search history.

(56) References Cited

U.S. PATENT DOCUMENTS 711,177 A * 10/1902 Richards ..... 473/360
711,228 A * 10/1902 Richards ..... 473/360
711,229 A * 10/1902 Richards ..... 473/360
711,230 A * 10/1902 Richards ..... 473/360

(Continued)

FOREIGN PATENT DOCUMENTS

JP H06-126015 5/1994
JP H11-076458 3/1999

(Continued)

OTHER PUBLICATIONS

International Search Report dated Aug. 21, 2012, 3 pages, Japan.

*Primary Examiner* — Steven Wong
(74) *Attorney, Agent, or Firm* — Thorpe North & Western

(57) ABSTRACT

A hard baseball ball is configured including a core layer, an intermediate layer, and the cover layer. The intermediate layer is formed on a spherical body by winding yarn having radio wave transmissivity, which allows radio waves to pass through, in a spherical shape around the core layer. The cover layer covers the intermediate layer, and is formed from a material with radio wave transmissivity. The hard baseball ball also includes the reflecting portion. The reflecting portion is formed on a spherical surface whose center is the center of the spherical body, and has radio wave reflectability. The reflecting portion is configured using yarn from which the intermediate layer is formed. At least a portion of the yarn from which the intermediate layer is formed is given radio wave reflectability, and the reflecting portion is configured from the portion of the yarn that has been given radio wave reflectability.

20 Claims, 6 Drawing Sheets

(56) References Cited

U.S. PATENT DOCUMENTS

| | | | | | |
|---|---|---|---|---|---|
| 716,348 | A * | 12/1902 | Richards | 473/360 |
| 727,200 | A * | 5/1903 | Richards | 473/363 |
| 895,476 | A * | 8/1908 | Lee | 473/356 |
| 1,553,386 | A * | 9/1925 | Kuhlke | 473/355 |
| 4,664,378 | A | 5/1987 | Van Auken | |
| 5,588,648 | A * | 12/1996 | Stebbins | 473/451 |
| 5,713,801 | A * | 2/1998 | Aoyama | 473/354 |
| 5,913,736 | A * | 6/1999 | Maehara et al. | 473/360 |
| 6,048,279 | A * | 4/2000 | Masutani | 473/372 |
| 6,270,427 | B1 * | 8/2001 | Derbin et al. | 473/361 |
| 6,893,361 | B2 * | 5/2005 | Morgan et al. | 473/362 |
| 7,976,416 | B2 * | 7/2011 | Kobayashi et al. | 473/570 |
| 2008/0254913 | A1 * | 10/2008 | Morgan | 473/360 |
| 2011/0118065 | A1 * | 5/2011 | Krysiak et al. | 473/603 |

FOREIGN PATENT DOCUMENTS

| | | |
|---|---|---|
| JP | 2004-166719 | 6/2004 |
| JP | 2007-021204 | 2/2007 |
| JP | 2007-175492 | 7/2007 |
| WO | WO 2011/074247 | 6/2011 |

* cited by examiner

| Experiment Example | Percentage of surface area (%) | Measuring time | Following distance |
|---|---|---|---|
| 1 | 5 | 100 | 100 |
| 2 | 10 | 110 | 105 |
| 3 | 20 | 110 | 108 |
| 4 | 30 | 112 | 110 |
| 5 | 40 | 112 | 110 |
| 6 | 50 | 112 | 110 |
| 7 | 60 | 110 | 107 |
| 8 | 70 | 105 | 103 |

FIG. 7

| Experiment Example | Mass percentage (%) | Reaction force | Measuring time | Following distance |
|---|---|---|---|---|
| 11 | 0.1 | 100 | 100 | 100 |
| 12 | 0.3 | 100 | 105 | 103 |
| 13 | 0.5 | 100 | 110 | 105 |
| 14 | 1 | 99 | 112 | 110 |
| 15 | 2 | 98 | 115 | 112 |
| 16 | 5 | 97 | 115 | 112 |
| 17 | 10 | 95 | 115 | 112 |
| 18 | 15 | 93 | 115 | 112 |
| 19 | 20 | 92 | 112 | 110 |

FIG. 8

| Experiment Example | Number of turns (No.) | Reaction force | Measuring time | Following distance |
|---|---|---|---|---|
| 21 | 5 | 100 | 100 | 100 |
| 22 | 10 | 100 | 105 | 103 |
| 23 | 20 | 100 | 110 | 108 |
| 24 | 50 | 100 | 112 | 110 |
| 25 | 100 | 99 | 115 | 112 |
| 26 | 200 | 98 | 115 | 112 |
| 27 | 300 | 98 | 112 | 110 |
| 28 | 400 | 96 | 112 | 110 |
| 29 | 500 | 95 | 112 | 110 |
| 30 | 600 | 95 | 110 | 108 |
| 31 | 700 | 94 | 105 | 103 |

FIG. 9

BALL FOR BALL GAME

TECHNICAL FIELD

The present technology relates to a ball for a ball game.

BACKGROUND TECHNOLOGY

In recent years devices using Doppler radar are used as measurement devices to measure the speed of travel, rate of rotation (amount of spin), and so on of balls for ball games.

In these devices, a transmission wave that includes microwaves is sent towards the ball for a ball game from an antenna, and the reflection wave reflected from the ball for a ball game is measured, and the speed of travel and the rate of rotation is obtained based on the Doppler signal obtained from the transmission wave and the reflection wave.

In these cases, the reflection wave must be obtained efficiently in order for the speed of travel and the rotation to be measured stably and reliably. In other words, efficiently obtaining the reflection wave is beneficial in the securing of measuring distance.

On the other hand, technology has been suggested for providing a layer or film including a metallic material throughout an entirety of a surface of a ball in order to enhance visual appearance and/or design (see Japanese Unexamined Patent Application Publication Nos. 2007-021204A, 2004-166719A and 2007-175492A).

Additionally, technology has been suggested for providing a metallic layer having a spherical surface shape between a core layer and a cover of a ball in order to ensure reaction (see Japanese Unexamined Patent Application No. H11-076458A).

According to tests carried out by the inventors of the present technology, it was found that although forming a layer or film that includes a metal material uniformly on the spherical surface of a ball is beneficial in terms of ensuring the radio wave reflection properties, the reflection wave tends to be reflected by the layer or film over only a comparatively narrow range by specular reflection of the transmission wave, so this is disadvantageous for receiving the reflection wave by the antenna.

As a result, insufficient measurement distance was provided for determining the speed of travel, the trajectory, and the rate of rotation which represent the behavior of the ball for a ball game.

SUMMARY

In light of the foregoing, the present technology provides a ball for a ball game favorable for precisely and accurately measuring the behavior of a ball for a game.

The ball for a ball game according to the present technology includes a spherical body formed by winding yarn having radio wave transmissivity in a spherical shape, and a reflecting portion having radio wave reflectability formed on a spherical surface whose center is the center of the spherical body, at least a portion of the yarn is given radio wave reflectability, and the reflecting portion is configured from the portion of the yarn that has been given radio wave reflectability.

According to the present technology, transmission waves emitted from the antenna of a measuring apparatus using Doppler radar are efficiently reflected by the reflecting portion of the ball for a ball game. In addition, the reflecting portion is configured from the portion of the yarn that has been given radio wave reflectability, so the transmission wave is reflected by the reflecting portion over a wide range of angles, so compared with the conventional case of specular reflection of the transmission wave the antenna can reliably receive the reflected wave, which is advantageous for ensuring the radio wave intensity of the reflected wave received by the antenna.

Therefore, this is advantageous for accurately and reliably measuring the behavior of the ball for a ball game, even when a measuring apparatus with weak radio wave output or low receiving sensitivity is used.

BRIEF DESCRIPTION OF THE DRAWINGS

FIG. 7 shows the measurement results for the experiment examples for percentage of surface area.

FIG. 8 shows the measurement results for the experiment examples for the mass percentage.

FIG. 9 shows the measurement results for experiment examples for the number of turns.

DETAILED DESCRIPTION

First Embodiment

Prior to describing the embodiments of the ball for a ball game of the present technology, a measuring apparatus for measuring the speed of travel and the rate of rotation of a ball for a ball game will be described.

The term "ball for a ball game" as used in the present technology includes balls used for competition, practice, amusement, and balls used for other purposes as well in ball games.

Figure 1:
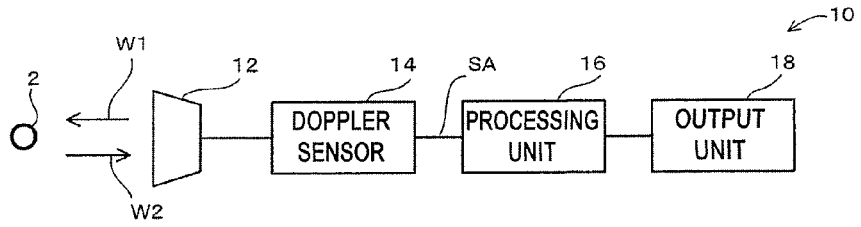
FIG. 1 is a block diagram illustrating a configuration of a measuring apparatus 10 using a Doppler radar for measuring launching conditions and/or measuring the trajectory of a ball for a ball game.

FIG. 1 is a block diagram illustrating the configuration of a measuring apparatus 10 using a Doppler radar for measuring the speed of travel and/or the trajectory of a ball for a ball game. In recent years this type of measuring apparatus is spreading as it is possible to use portable measuring instruments with particularly low electrical power consumption.

Also, in this embodiment, the ball for a game is a hard baseball ball 2, and the following is a description of measurement of the speed of travel of the hard baseball ball 2.

As illustrated in FIG. 1, the measuring apparatus 10 has a configuration including an antenna 12, a Doppler sensor 14, a processing unit 16, and an output unit 18.

Based on a transmission signal supplied from the Doppler sensor 14, the antenna 12 transmits a transmission wave W1 (microwaves) toward the hard baseball ball 2, receives a reflection wave W2 reflected by the hard baseball ball 2, and supplies the received signal to the Doppler sensor 14.

The hard baseball ball 2 is thrown in the air by pitching, or launched into the air by being struck with a bat.

The Doppler sensor 14 detects a Doppler signal Sd by supplying the transmission signal to the antenna 12 and receiving the received signal supplied from the antenna 12.

The "Doppler signal" is a signal having a Doppler frequency Fd defined by a frequency F1–F2, which is a difference between a frequency F1 of the transmission signal and a frequency F2 of the received signal.

Examples of the transmission signal include 24 GHz or 10 GHz microwaves.

The processing unit 16 measures the speed of travel and the rate of rotation of the hard baseball ball 2 based on the Doppler signal Sd supplied from the Doppler sensor 14.

The output unit 18 outputs the measured value measured by the processing unit 16.

Specifically, the output unit 18 display-outputs the measured value using a display device such as a liquid crystal panel, or, alternatively, print-outputs the measured value using a printer.

Additionally, the output unit 18 may supply the measured value to an external device such as a personal computer or the like.

Here, measurement of the speed of travel of the hard baseball ball 2 is described.

As known conventionally, the Doppler frequency Fd is expressed by Formula (1).

$$Fd=F1-F2=2\cdot V\cdot F1/c \quad (1)$$

where V: speed of the hard baseball ball 2, c: speed of light ($3\times10^8$ m/s)

Thus, when Formula (1) is solved for V, Formula (2) is arrived at.

$$V=c\cdot Fd/(2\cdot F1) \quad (2)$$

In other words, the velocity V of the hard baseball ball 2 is proportional to the Doppler frequency Fd.

Thus, the Doppler frequency Fd can be detected from the Doppler signal Sd and the velocity V can be calculated from the Doppler frequency Fd.

Next, measurement of the rate of rotation of the hard baseball ball 2 is specifically described.

Figure 2:
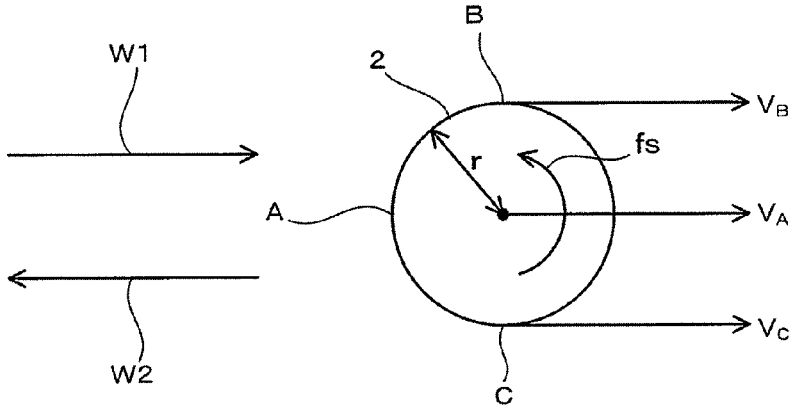
FIG. 2 is an explanatory view of the principle for measuring the rate of rotation of a hard baseball ball 2.

FIG. 2 is an explanatory view of the principle for measuring the rate of rotation of the hard baseball ball 2.

The transmission wave W1 reflects efficiently at a first portion A of the surface of the hard baseball ball 2, which is a portion of the surface where the angle formed with the transmission direction of the transmission wave W1 is close to 90 degrees. Thus, the intensity of the reflection wave W2 at the first portion A is high.

On the other hand, the transmission wave W1 does not reflect efficiently at a second portion B and a third portion C of the surface of the hard baseball ball 2, which are portions of the surface where the angle formed with the transmission direction of the transmission wave W1 is close to 0 degrees. Thus, the intensity of the reflection wave W2 at the second portion B and the third portion C is low.

The second portion B is a portion where the direction of movement due to rotation of the hard baseball ball 2 is in the opposite orientation to the direction of movement of the hard baseball ball 2.

The third portion C is a portion where the direction of movement due to rotation of the hard baseball ball 2 is in the same orientation as the direction of movement of the hard baseball ball 2.

When a first velocity VA is a velocity detected based on the reflection wave W2 reflected at the first portion A, a second velocity VB is a velocity detected based on the reflection wave W2 reflected at the second portion B, and a third velocity VC is a velocity detected based on the reflection wave W2 reflected at the third portion C, the following formulas are achieved:

$$VA=V \quad (1)$$

$$VB=VA-\omega r \quad (2)$$

$$VC=VA+\omega r \quad (3)$$

(where V is the speed of travel of the hard baseball ball 2, ω is the angular velocity (rad/s), and r is the radius of the hard baseball ball 2).

Thus, if the first, second, and third velocities VA, VB, and VC can be measured, the speed of travel V of the hard baseball ball 2 can be calculated from the first velocity VA based on Formula (1). Additionally, since the angular velocity ω can be calculated from the second and third velocities VB and VC based on Formulas (2) and (3), the rate of rotation can be calculated from the angular velocity ω.

Next, the measurement of the first, second, and third velocities VA, VB, and VC is described.

Figure 3:
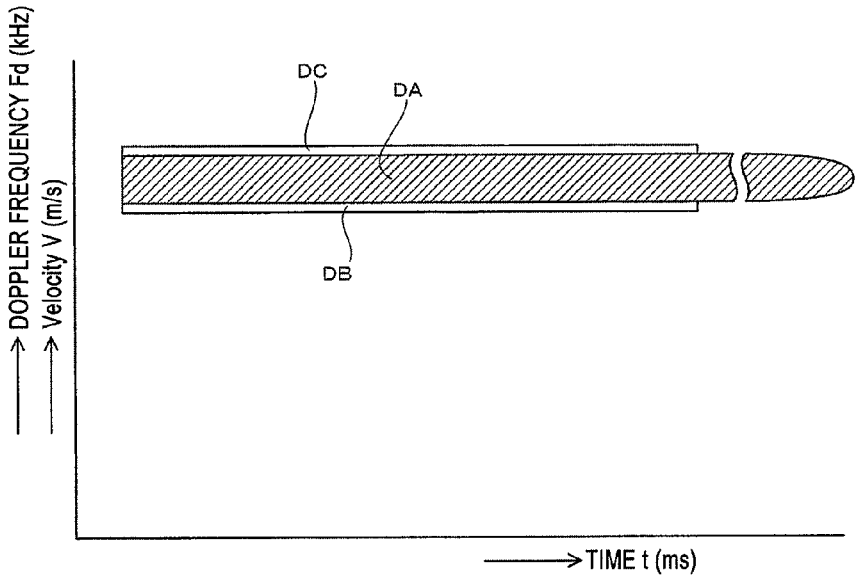
FIG. 3 illustrates the results of a wavelet analysis of a Doppler signal Sd in the case of measurement using the measuring apparatus 10 of the hard baseball ball 2 launched with a special device.

FIG. 3 illustrates the results of a wavelet analysis of a Doppler signal Sd in the case of measurement using the measuring apparatus 10 of the hard baseball ball 2 launched with a special device.

Time t (ms) is shown on the horizontal axis and the Doppler frequency Fd (kHz) and the velocity V (m/s) of the hard baseball ball 2 are shown on the vertical axis.

Such a line chart is obtained by, for example, sampling and capturing the Doppler signal Sd in a digital oscilloscope, converting the Doppler signal Sd to digital data, and using a personal computer or the like to perform a wavelet analysis or an FFT analysis.

In the frequency distribution shown in FIG. 3, an intensity of the Doppler signal Sd is high in the portion illustrated using cross-hatching, and the intensity of the Doppler signal Sd in the portion illustrated using solid lines is lower than that of the portion illustrated using the cross-hatching.

Thus, signal intensity of the frequency distribution at the area labeled DA, a portion corresponding to the first velocity VA, is high.

Signal intensity of the frequency distribution at the area labeled DB, a portion corresponding to the second velocity VB, is low.

Signal intensity of the frequency distribution at the area labeled DC, a portion corresponding to the third velocity VB, is low.

Thus, by performing an analysis of the intensity of the Doppler signal Sd based on frequency, the frequency distributions DA, DB, and DC, are identified, and the first, second, and third velocities VA, VB, and VC can be obtained from the frequency distributions DA, DB, and DC, respectively, as time series data by using the principles of the Formulas (1), (2), and (3) described above.

Such processing is possible using one of various conventional signal processing circuits, or, alternatively, a microprocessor that operates based on a signal processing program.

Next, the hard baseball ball according to the first embodiment is described.

Figure 4:
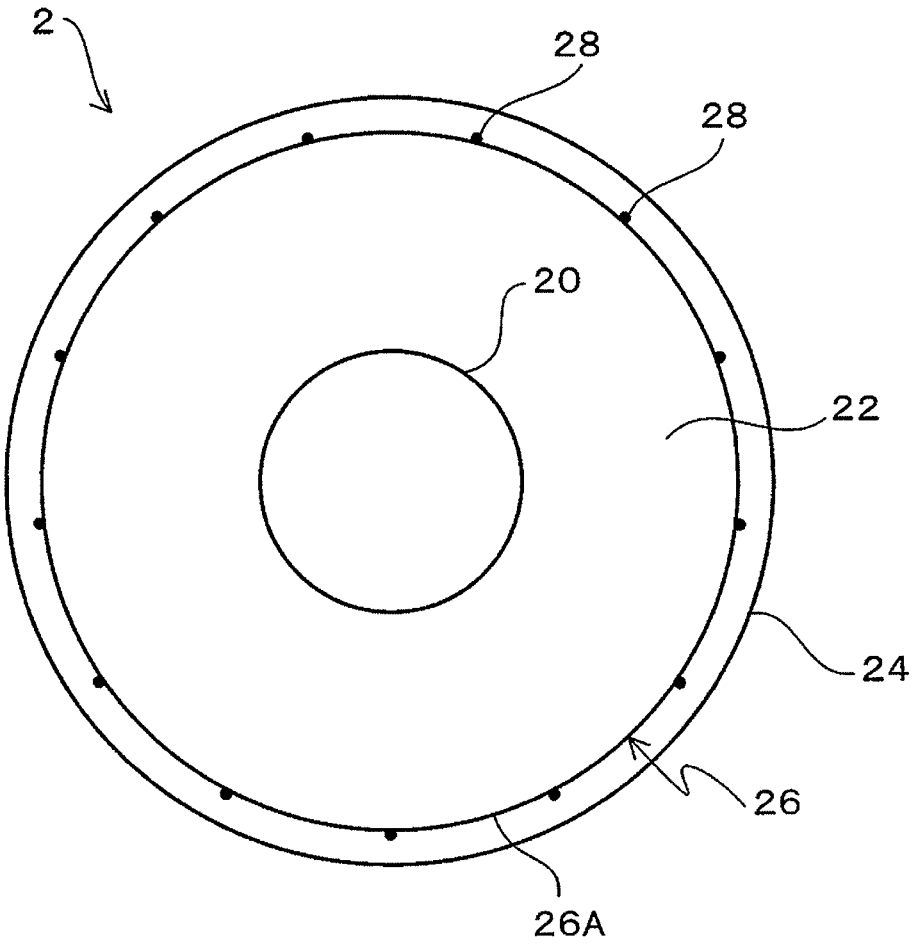
FIG. 4 is a cross-sectional view of a hard baseball ball 2 according to a first embodiment.
Figure 5:
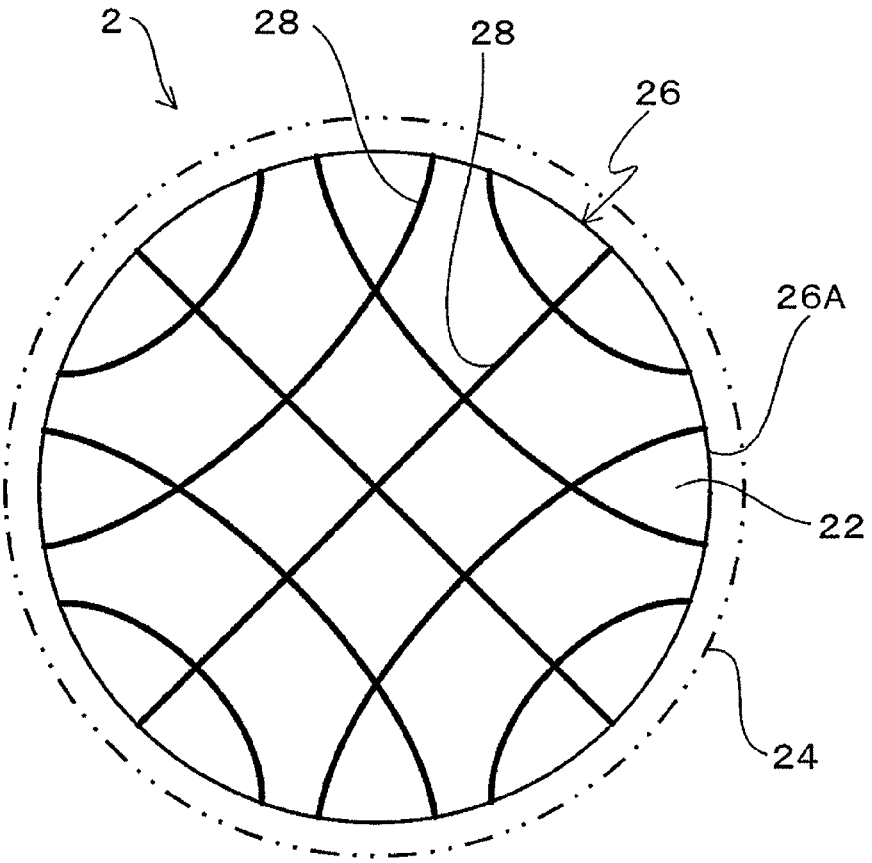
FIG. 5 is a front view illustrating the state when the cover layer 24 of the hard baseball ball 2 according to the first embodiment is transparent.

FIG. 4 is a cross-sectional view of a hard baseball ball 2 according to the first embodiment, and FIG. 5 is a front view illustrating the state when a cover layer 24 of the hard baseball ball 2 of the FIG. 4 is transparent.

The hard baseball ball 2 is configured including a core layer 20, an intermediate layer 22, and the cover layer 24.

The core layer 20 is spherical and solid, for example, various conventionally known materials such as rubber or cork and so on can be used.

The intermediate layer 22 is formed on a spherical body 26 by winding yarn having radio wave transmissivity, which allows radio waves to pass through, in a spherical shape around the core layer 20, so, the intermediate layer 22 is configured from a wound yarn layer.

The cover layer 24 covers the intermediate layer 22, cowhide, for example, is used as the material of the cover layer 24, and the cover layer 24 is formed by stitching the cowhide using yarn so as to cover the intermediate layer 22.

In other words, in the present embodiment, the cover layer 24 is formed from a material that allows passage of radio waves such as, for example, a material that does not contain an electrically conductive substance so that radio waves will be reflected by a reflecting portion 28, which is described later.

The hard baseball ball 2 also includes the reflecting portion 28.

The reflecting portion 28 is formed on a spherical surface whose center is the center of the spherical body 26, and has radio wave reflectability.

In the present embodiment, the spherical surface on which the reflecting portion 28 is formed is the spherical surface 26A of the spherical body 26, but the spherical surface on which the reflecting portion 28 is formed may be a spherical surface located inward of the spherical surface 26A of the spherical body 26.

Also, the reflecting portion 28 is configured using the yarn that forms the intermediate layer 22.

In other words, at least a portion of the yarn that forms the intermediate layer 22 is given radio wave reflectability, and the reflecting portion 28 is configured from the portion of the yarn that has been given radio wave reflectability.

The portion of the yarn that has been given radio wave reflectability may be configured as follows.

(1) Form all the yarn from which the intermediate layer 22 is configured from a material not having radio wave reflectability, such as knitting yarn or cotton yarn or the like. Then, the portion of the yarn can be given radio wave reflectability by, for example, impregnating with an electrically conductive material such as a copper chemical substance or the like.

(2) Form all the yarn from which the intermediate layer 22 is configured from a material not having radio wave reflectability such as knitting yarn or cotton yarn or the like. Then, the portion of the yarn can be given radio wave reflectability by, for example, vapor deposition of an electrically conductive material such as aluminum, stainless steel, nickel, and so on.

(3) Form all the yarn from which the intermediate layer 22 is configured from a material not having radio wave reflectability such as knitting yarn or cotton yarn or the like. Then, the portion of the yarn can be given radio wave reflectability by, for example, plating with an electrically conductive material such as copper, nickel, and so on.

(4) Form the intermediate layer 22 using two types of yarn: a yarn formed from a material with radio wave transmissivity such as knitting yarn, cotton yarn, or the like, and a yarn formed from an electrically conductive material (for example, metal wire or carbon fiber). For example, the spherical body can be formed from yarn having radio wave transmissivity, and finally the reflecting portion 28 can be formed by winding electrically conductive yarn on the surface of the spherical body. Alternately, for example the spherical body can be formed from yarn having radio wave transmissivity, the reflecting portion 28 can be formed by winding electrically conductive yarn on the surface of the spherical body, and winding yarn having radio wave transmissivity on the reflecting portion 28 so as to cover the reflecting portion 28.

In each of the cases (1) to (4) described above, the reflecting portion 28 is formed by the portion of the yarn that is electrically conductive.

It is sufficient that the reflecting portion 28 be able to ensure a sufficient intensity of the reflection wave W2, for example, by applying the conventionally known relational expression given below, the necessary range can be calculated as the surface resistance of the reflecting portion 28.

Specifically, when Γ is radio wave reflectance and R is surface resistance the following formulas (10) and (11) are achieved:

$$\Gamma=(377-R)/(377+R) \tag{10}$$

$$R=(377(1-\Gamma))/(1+\Gamma) \tag{11}$$

Γ=1 indicates complete reflectance, Γ=0 indicates zero reflectance, and 377 indicates the characteristic impedance of the air.

Thus, from Formula (11):

when Γ=1, R=0; and when Γ=0, R=377.

Here, when Γ=0.5, R=377(0.5/1.5)≈130.

Thus, when a value sufficient as the radio wave reflectance Γ is set to not less than 64 =0.5 (50%), the surface resistance R must be not more than 130 Ω/sq.

Additionally, from the perspective of ensuring the intensity of the reflection wave W2, preferably the radio wave reflectance Γ is not less than 0.9 (90%) and the surface resistance R is not more than 20 Ω/sq.

Note that the radio wave reflectance Γ can be measured using a conventional method such as a waveguide method, a free space method, or the like.

Also, when the reflecting portion 28 is formed on the surface 26A of the spherical body 26, preferably the percentage of the surface area occupied by the reflecting portion 28 is at least 10% in order to ensure the intensity of the reflection wave W2, and more preferably the percentage of the surface area occupied is at least 20% and not more than 60% in order to ensure the intensity of the reflection wave W2.

Also, when the reflecting portion 28 is formed on the surface 26A of the spherical body 26, preferably the number of turns of the portion of the yarn from which the reflecting portion 28 is configured is 5 to 500 turns in order to ensure the intensity of the reflection wave W2 while ensuring the same degree of reaction force and batting feel as a conventional hard baseball ball when the hard baseball ball is struck by a bat, and more preferably is 20 to 200 turns.

Also, the mass of the portion of the yarn from which the reflecting portion 28 is configured is preferably not more than 10% of the total mass of the hard baseball ball 2 in order to ensure the intensity of the reflection wave W2 while ensuring the same degree of reaction force and batting feel as a conventional hard baseball ball when the hard baseball ball is struck by a bat, and more preferably is 0.5% to 5% of the total mass of the hard baseball ball 2.

Next, the effects of the hard baseball ball 2 of this embodiment will be described.

The reflecting portion 28 having radio wave reflectability formed on the spherical surface whose center is the center of the spherical body 26 is formed in the hard baseball ball 2 according to the present embodiment. Therefore, the transmission wave W1 emitted from the antenna 12 of the measuring apparatus 10 is efficiently reflected by the reflecting portion 28 of the hard baseball ball 2.

In addition, the reflecting portion 28 is configured from the portion of the yarn that has been given radio wave reflectability, so the transmission wave W2 is reflected by the reflecting portion 28 over a wide range of angles, so compared with specular reflection of the transmission wave as in the conventional case, the antenna 12 can reliably receive the reflection wave, which is advantageous for ensuring the radio wave intensity of the reflection wave W2 received by the antenna 12.

Therefore it is possible to ensure the signal intensity of the Doppler signal for a longer period of time, which is advantageous for stably and reliably measuring the speed of travel and the trajectory.

Also, the transmission wave W1 emitted from the antenna 12 is reflected by the reflecting portion 28 that has radio wave reflectability formed on the spherical surface whose center is the center of the spherical body 26 which moves as the hard baseball ball 2 rotates. This is advantageous from the perspective of ensuring the radio wave intensity of the reflection wave W2.

Therefore, even if the signal intensity of the reflection wave W2 received by the antenna 12 declines due to the increase in distance between the hit hard baseball ball 2 and the antenna 12, the signal intensity of each of the frequency distributions DA, DB, and DC can be ensured.

Particularly, signal intensities of the frequency distributions DB and DC, which are always weaker than the signal intensity of the frequency distribution DA, can be ensured, which is advantageous from the perspective of stably measuring the second and third velocities VB and VC.

In other words, signal intensity of the frequency distributions necessary to detect the rate of rotation included in the Doppler signal can be ensured, which is advantageous from the perspective of stably and reliably detecting the rate of rotation.

Therefore, the rate of rotation can be stably measured over a longer period of time due to being able to measure the second and third velocities VB and VC over a longer period of time.

Therefore it is possible to accurately calculate the rate of rotation of the hard baseball ball 2, which is advantageous for more accurately analyzing the behavior of the hard baseball ball 2.

In this way it is possible to ensure the signal intensity of the reflection wave W2 received by the antenna 12, which is advantageous for accurately and reliably measuring the speed of travel, the trajectory, and the rate of rotation even when using a measuring apparatus 10 with a weak radio wave output or an antenna receiving sensitivity that is not very high, or when a special low electrical power portable measuring instrument is used.

Also, the radio wave intensity of the reflection wave W2 can be ensured, so it is possible to reduce the intensity of the radio wave output of the measuring apparatus 10 or the receiving sensitivity of the antenna, and this is advantageous for simplifying, reducing the size, and reducing the cost of the measuring apparatus 10.

Also, in the present embodiment, the reflecting portion 28 is protected by the cover layer 24, so when the hard baseball ball 2 is struck by a bat, damage to the reflecting portion 28 is minimized, which is advantageous for increasing the durability.

Also, the reflecting portion 28 of the hard baseball ball 2 of the present embodiment is configured from the portion of the yarn that has been given radio wave reflectability, so the structure can be virtually the same as the conventional hard baseball ball.

Therefore, it is not necessary to greatly change the manufacturing process of the conventional hard baseball ball, so existing equipment can be used, which is advantageous for minimizing the manufacturing cost.

Second Embodiment

Next, a second embodiment will be described. In this embodiment, elements identical to those of the first embodiment are assigned identical reference numerals, and detailed descriptions thereof are omitted.

The second embodiment is a modified example of the first embodiment, in which the position where the reflecting portion 28 is formed is different from that of the first embodiment.

Figure 6:
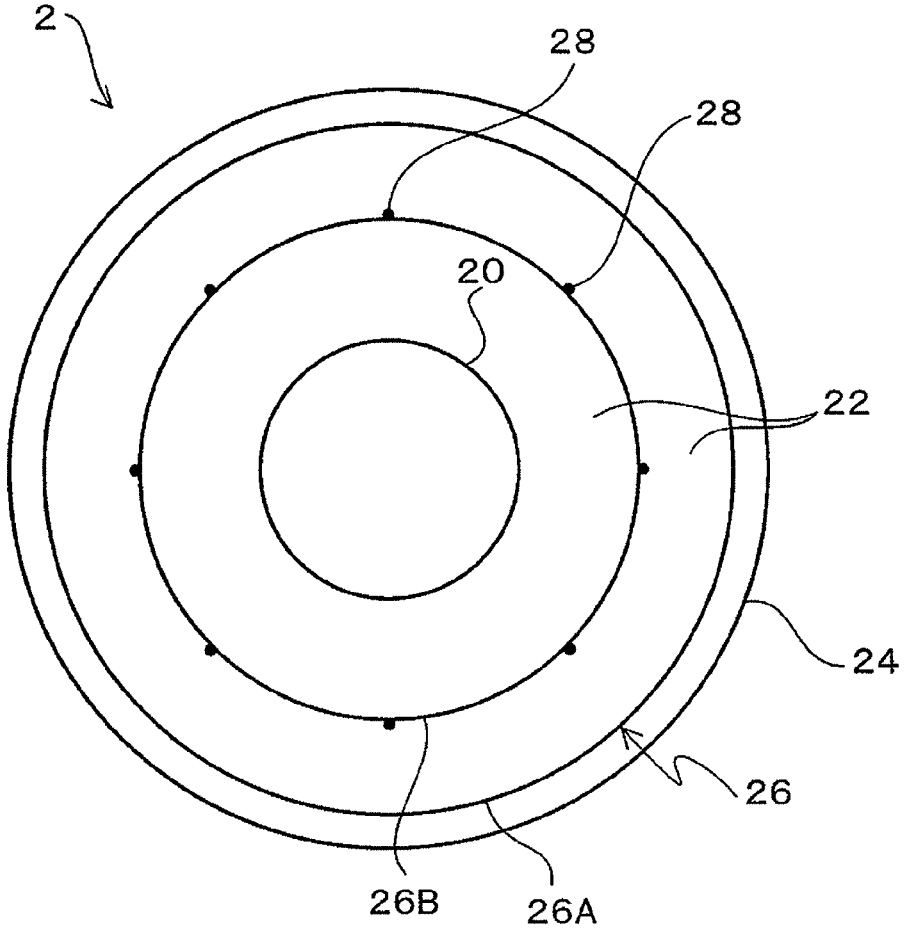
FIG. 6 is a cross-sectional view of a hard baseball ball 2 according to a second embodiment.

In other words, in the first embodiment the reflecting portion 28 is formed on the surface 26A of the spherical body 26, but in the second embodiment the reflecting portion 28 is formed in the interior of the spherical body 26, as illustrated in FIG. 6.

In other words, a spherical surface 26B on which the reflecting portion 28 is formed is positioned inward of the surface 26A of the spherical body 26, and the reflecting portion 28 is covered by the yarn having radio wave transmissivity from which the intermediate layer 22 is formed.

Also, when the reflecting portion 28 is formed on the spherical surface 26B of the spherical body 26, preferably the percentage of the surface area of the spherical surface 26B occupied by the reflecting portion 28 is at least 10% in order to ensure the intensity of the reflection wave W2, and more preferably the percentage of the surface area of the spherical surface 26B occupied is at least 20% and not more than 60% in order to ensure the intensity of the reflection wave W2.

With the second embodiment described above, the same effects as provided by the first embodiment are provided.

Also, the reflecting portion 28 is protected by the cover layer 24 and the yarn having radio wave transmissivity from which the intermediate layer 22 is configured, so peeling of the reflecting portion 28 when the hard baseball ball 2 is struck by a bat is minimized, which is advantageous for improving the durability.

Also, as illustrated in FIG. 5, when spacing is provided between the yarn from which the reflecting portion 28 is configured, steps (recesses and protrusions) are produced between the portion of the yarn from which the reflecting portion 28 is configured and the portion of the yarn other than the reflecting portion 28. Therefore, in the second embodiment, the portion of the yarn from which the reflecting portion 28 is configured is covered by the portion of the yarn having radio wave transmissivity from which the intermediate layer 22 is configured, so it is possible to minimize the steps of the portion of yarn from which the reflecting portion 28 is configured from appearing as concavo-convex shapes on the outside of the cover layer 24, and it is possible to improve the external appearance.

EXPERIMENT EXAMPLES

Next, experiment examples will be described.

First, experiment examples for percentage of surface area are described.

Hard baseball balls 2 according to the first embodiment were manufactured under the following conditions.

Experiment Example 1

Percentage of Surface Area 5%

Experiment Example 2

Percentage of Surface Area 10%

Experiment Example 3

Percentage of Surface Area 20%

Experiment Example 4

Percentage of Surface Area 30%

Experiment Example 5

Percentage of Surface Area 40%

Experiment Example 6

Percentage of Surface Area 50%

Experiment Example 7

Percentage of Surface Area 60%

Experiment Example 8

Percentage of Surface Area 70%

Each of the hard baseball balls 2 configured in this way were launched by a special ball launching device (pitching machine) and measured using a measuring apparatus 10, and the variation with time of the rate of rotation of the hard baseball ball 2 was obtained.

The initial velocity applied to the hard baseball balls 2 by the ball launching device was 100 km/h, and the rate of rotation applied to the hard baseball balls 2 was 3,000 rpm.

The number of hard baseball balls 2 measured for Experiment Examples 1 to 8 was 10 each.

FIG. 7 shows the measuring time and following distance of the rate of rotation in Experiment Examples 1 to 8, and the average values of measurements for ten hard baseball balls 2 are shown.

However, the measuring time and the following time are shown relative to Experiment Example 1 as an index of 100.

The larger the index of measuring time the longer the measuring time, and the larger the index of following distance the longer the following distance.

As shown in FIG. 7, it can be seen that when the percentage of surface area occupied is 10% or more, it is advantageous for ensuring the measuring time and the following time, and when the percentage of the surface area occupied is 20% or more and not more than 60%, it is more advantageous for ensuring the measuring time and the following time.

From these experimental results, using the hard baseball ball 2 according to the present embodiment is advantageous for ensuring the intensity of the reflection wave W2, therefore it is possible to ensure the measuring time and following distance of the rate of rotation, and it has been shown that this is advantageous for stably and reliably measuring the rate of rotation.

Also, it is possible to ensure the intensity of the reflection wave W2, so the measuring time and the following distance can be ensured when measuring the speed of travel and the trajectory, the same as for the rate of rotation, which is advantageous for stably and reliably measuring the speed of travel and the trajectory.

Next, the experiment examples are described for the mass percentage, which is the mass of the portion of the yarn (electrically conductive yarn) from which the reflecting portion 28 is configured as a percentage of the total mass of the ball for a ball game.

Hard baseball balls 2 according to the first embodiment were manufactured under the following conditions.

Experiment Example 11

Mass Percentage 0.1%

Experiment Example 12

Mass Percentage 0.3%

Experiment Example 13

Mass Percentage 0.5%

Experiment Example 14

Mass Percentage 1%

Experiment Example 15

Mass Percentage 2%

Experiment Example 16

Mass Percentage 5%

Experiment Example 17

Mass Percentage 10%

Experiment Example 18

Mass Percentage 15%

Experiment Example 19

Mass Percentage 20%

For each of the hard baseball balls 2 configured in this way the rate of rotation measuring time and following distance were measured under the same conditions for FIG. 6. The reaction force was also measured.

The number of hard baseball balls 2 measured for Experiment Examples 11 to 19 was 10 each.

FIG. 8 shows the reaction force and the measuring time and following distance of the rate of rotation in Experiment Examples 11 to 19, and the average values of measurements for ten hard baseball balls 2 are shown.

However, the reaction force, the measuring time, and the following time are shown relative to Experiment Example 11 as an index of 100.

The larger the index of reaction force the greater the reaction force.

As shown in FIG. 8, as the mass percentage increases (as the electrically conductive yarn increases) the reaction force reduces.

In Experiment Examples 11 and 12 the measuring time, the following distance, and the reaction force were sufficient.

In Experiment Examples 13 to 16 the measuring time and the following distance were good, and the reaction force was appropriate.

In Experiment Example 17, the measuring time and the following distance were in a good range, and the reaction force was sufficient.

In Experiment Examples 18 and 19, the measuring time and the following distance were in a good range, and the reaction force was sufficient, and because the mass percentage was large the range of applications as a ball for a ball game was wider, which is desirable.

From these test results it can be seen that preferably the mass percentage is not more than 10% to ensure the intensity of the reflection wave W2 while ensuring the same level of reaction force and batting feel as a conventional baseball ball, and more preferably the mass percentage is 0.5% to 5%.

Next, the experiment examples for the number of turns of the portion of the yarn (electrically conductive yarn) from which the reflecting portion 28 is configured are described.

Hard baseball balls 2 according to the first embodiment were manufactured under the following conditions.

Experiment Example 21

Number of Turns 5

Experiment Example 22

Number of Turns 10

Experiment Example 23

Number of Turns 20

Experiment Example 24

Number of Turns 50

Experiment Example 25

Number of Turns 100

Experiment Example 26

Number of Turns 200

Experiment Example 27

Number of Turns 300

Experiment Example 28

Number of Turns 400

Experiment Example 29

Number of Turns 500

Experiment Example 30

Number of Turns 600

Experiment Example 31

Number of Turns 700

For each of the hard baseball balls 2 configured in this way the reaction force, the rate of rotation measuring time and following distance were measured under the same conditions for FIG. 8.

The number of hard baseball balls 2 measured for experiment examples 21 to 31 was 10 each.

FIG. 9 shows the reaction force and the measuring time and following distance of the rate of rotation in Experiment Examples 21 to 31, and the average values of measurements for ten hard baseball balls 2 are shown.

However, the reaction force, the measuring time, and the following time are shown relative to Experiment Example 21 as an index of 100.

As shown in FIG. 9, as the number of turns increases (as the electrically conductive yarn increases) the reaction force reduces.

In Experiment Examples 21 and 22, the measuring time and the following distance were sufficient.

In Experiment Examples 23 to 26 the measuring time and the following distance were good, and the reaction force was appropriate.

In Experiment Examples 27 to 29, the measuring time and the following distance were in a good range, and the reaction force was sufficient.

In Experiment Examples 30 and 31, the measuring time and the following distance were in a good range, and the reaction force was sufficient, and because the number of turns was large the range of applications as a ball for a ball game was wider, which is desirable.

From these test results it can be seen that preferably the number of turns of the portion of yarn from which the reflecting portion 28 is configured is 5 to 500 in order to ensure the intensity of the reflection wave W2 while ensuring the same level of reaction force and batting feel as a conventional hard baseball ball, and more preferably the number or turns is 20 to 200.

Also, in the embodiments, the case in which the ball for a ball game was a hard baseball ball was described, but the present technology can be widely applied to balls for a ball game that include a spherical body formed by winding yarn into a spherical shape.

The invention claimed is:

1. A ball for a ball game, comprising:

a spherical body formed by winding a yarn having radio wave transmissivity into a spherical shape; and a radio wave reflectability-given reflecting portion that is formed from a portion of the yarn having the radio wave transmissivity and an electrically conductive material, thereby to be reflective to radio waves, wherein the reflecting portion is disposed on a spherical surface whose center is the center of the spherical body.

2. The ball for a ball game according to claim 1, wherein the yarn having the radio wave transmissivity is a knitting yarn or a cotton yarn and the reflecting portion of the yarn is formed from a metal wire or carbon fiber.

3. The ball for a ball game according to claim 1, wherein the reflecting portion of the yarn is impregnated with the electrically conductive material, or, the electrically conductive material is vapor deposited on the reflecting portion of the yarn, or, the reflecting portion of the yarn is plated with the electrically conductive material.

4. The ball for a ball game according to claim 1, wherein the surface resistance of the reflecting portion of the yarn is 130 Ω/sq. or less.

5. The ball for a ball game according to claim 1, wherein the mass of the reflecting portion of the yarn is 10% of the total mass of the ball for a ball game or less.

6. The ball for a ball game according to claim 1, wherein the reflecting portion is formed on the surface of the spherical body, and the percentage of the surface occupied by the reflecting portion is 10% or more.

7. The ball for a ball game according to claim 1, wherein the reflecting portion is formed on the surface of the spherical body, and the percentage of the surface occupied by the reflecting portion is 20% or more and 60% or less.

8. The ball for a ball game according to claim 1, wherein the reflecting portion is formed on the surface of the spherical body, and the number of turns of the portion of the yarn from which the reflecting portion is configured is 5 to 500.

9. The ball for a ball game according to claim 1, wherein the reflecting portion is formed on a spherical surface located inward from the surface of the spherical body.

10. The ball for a ball game according to claim 9, wherein the percentage of the surface occupied by the reflecting portion is 10% or more.

11. The ball for a ball game according to claim 9, wherein the percentage of the surface occupied by the reflecting portion is 20% or more and 60% or less.

12. The ball for a ball game according to claim 1, wherein the ball for a ball game is a hard baseball ball, and a cover layer is provided covering the spherical body.

13. The ball for a ball game according to claim 1, wherein the reflecting portion is formed on the surface of the spherical body, and the number of turns of the portion of the yarn from which the reflecting portion is configured is 20 to 200.

14. The ball for a ball game according to claim 1, wherein a mass of the reflecting portion of the yarn is not more than 10% of a total mass of the ball.

15. The ball for a ball game according to claim 14, wherein the mass of the reflecting portion of the yarn is from 0.5% to 5% of the total mass of the ball.

16. The ball for a ball game according to claim 1, wherein the radio wave reflectability Γ and a surface resistance R of the reflecting portion of the yarn are related by the formulas:

$$\Gamma=(377-R)/(377+R); \text{ and}$$

$$R=(377(1-\Gamma))/(1+\Gamma).$$

17. The ball for a ball game according to claim 16, wherein the radio wave reflectance Γ is not less than 0.5 and the surface resistance R is not more than 130 Ω/sq.

18. The ball for a ball game according to claim 16, wherein the radio wave reflectance Γ is not less than 0.9 and the surface resistance R is not more than 20 Ω/sq.

19. The ball for a ball game according to claim 12, wherein cover layer is a cowhide cover layer.

20. The ball for a ball game according to claim 1, wherein the spherical surface on which the reflecting portion is disposed exists between a core layer and a cover layer.

* * * * *